US007795516B2

(12) United States Patent
Toone

(10) Patent No.: US 7,795,516 B2
(45) Date of Patent: Sep. 14, 2010

(54) NEUTRAL TENSION BRIDGE

(76) Inventor: Richard Warren Toone, P.O. Box 471, Milford, NJ (US) 08848

( * ) Notice: Subject to any disclaimer, the term of this patent is extended or adjusted under 35 U.S.C. 154(b) by 14 days.

(21) Appl. No.: 12/288,900

(22) Filed: Oct. 25, 2008

(65) Prior Publication Data

US 2010/0101397 A1 Apr. 29, 2010

(51) Int. Cl.
*G10D 3/00* (2006.01)

(52) U.S. Cl. ..... 84/313

(58) Field of Classification Search ..... 84/267, 84/312 R, 307–309, 313
See application file for complete search history.

(56) References Cited

U.S. PATENT DOCUMENTS 7,112,733 B1 9/2006 Babicz

2008/0053288 A1 * 3/2008 Brunkalla ..... 84/267

* cited by examiner

*Primary Examiner*—Kimberly R Lockett

(57) ABSTRACT

A bridge mechanism for keeping at least one string on a musical instrument at a desired tension, having:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once.

11 Claims, 9 Drawing Sheets

NEUTRAL TENSION BRIDGE

FIELD OF THE INVENTION

The present invention relates to musical instruments. More specifically, the invention relates to a bridge mechanism for keeping a stringed instrument in tune through a string contact point located at an appropriate intonation harmonic. An additional function of the bridge is to couple vibration of the strings to the vibration of the soundboard, amplifying string movement.

BACKGROUND INFORMATION

Stringed instruments have been around for thousands of years. Conventionally, a string is placed under longitudinal tension until it vibrates at a pre-determined pitch when plucked, bowed, picked, or otherwise induced to vibrate. String vibration is then amplified through coupling to a resonant structure known as a soundboard, or electronically through a transducer. The coupling mechanism is known as a bridge.

Maintaining accurate pitch has always been a challenge, as the force exerted by multiple strings under tension is quite significant, causing instruments to deform. Instruments must withstand string tension yet be light weight in order to be easily held, played, or transported by musicians. Conventional, instruments are resonant in order to efficiently amplify string vibrations and respond with sensitivity to a player's touch.

Conventional technologies use a front mounted placement. Strings contact a bridge mechanism, and contact is maintained through string direction change (tangential, lateral), relative to the length of the string (longitudinal). Two conventional bridge formats exist, differentiated by string termination points: downward force bridges, and attachment point bridges:

a. Conventional downward force bridges use downward force (tangential, lateral) —against the front of the instrument—to couple the string to the soundboard, with string termination points located independently of the bridge. Longitudinal string tension is redirected tangentially, or laterally. Examples include: violin, cello, archtop guitar, etc.

b. Conventional attachment point bridges, terminate strings on the soundboard, either as part of the bridge mechanism, or independently located. Longitudinal string tension is applied directly to the soundboard, either longitudinally, tangentially, or laterally. Examples include: acoustic guitar, electric guitar & bass, etc.

There are significant problems with conventional technologies that include:

a. Both downward force and attachment point bridges restrict soundboard and string vibration due to string tension applied directly to the soundboard: the higher the pitch, for a given string, the greater the tension applied to the soundboard. The greater the tension, the greater the vibrational restriction, for both soundboard and string. Restricted string and soundboard vibration results in reduced musical sensitivity, sustain, and harmonic detail.

b. In order to counteract string tension applied to the soundboard, various bracing schemes have been devised. Every form of soundboard bracing adds mass to the soundboard, slowing directional change, and restricting vibrational movement. Additional bracing requires additional material, maintenance and expense, as well as opportunities for joint fatigue or failure.

c. Conventional technologies are particularly vulnerable to changes in string tension or environmental temperature and humidity. Because string pitch (tuning and intonation) is directly dependent upon string coupling to the soundboard, any alteration to the geometry or relationship between the string and soundboard interactively affects tuning, intonation, and the structural integrity of the instrument.

There is a need for a bridge mechanism to facilitate vibrational coupling between string and soundboard, yet dissociate—or greatly reduce, in comparison to conventional technologies—longitudinal, tangential, and lateral string tension from the coupling process.

There is a further need for a bridge mechanism that allows the soundboard to be designed in such a manner as to remain independent of the necessity to withstand longitudinal (including tangential and lateral) string tension. Building upon the previous paragraph above, the soundboard can disassociate from structural necessity, i.e., function independently of form, shape, size, configuration, integrity, and design issues related to the remainder of the instrument.

There is also a need for a bridge mechanism to simply adjust the relationship between string and fingerboard, thus affecting playability (force required to fret a note at a given pitch) and intonation, without requiring interactive adjustments to the soundboard, soundboard bracing, or neck (fingerboard) angle in relation to the soundboard or bridge.

There is a need for a bridge mechanism to facilitate soundboard designs that require less structural bracing, thus simplifying construction, maintenance, and reducing mechanical failure opportunities.

There is a need for a bridge mechanism to facilitate soundboard designs that require less mass, thus increasing the directional vibrational responsiveness of the soundboard and enhancing transient detail, overtone, and note articulation amplification.

SUMMARY OF THE INVENTION

It is therefore an objective of the invention to provide a bridge mechanism to facilitate vibrational coupling between string and soundboard, yet dissociate—or greatly reduce, in comparison to conventional technologies—longitudinal, tangential, and lateral string tension from the coupling process, e.g., neutral tension bridge. Benefits will include:

a. Dissociative—or greatly reduced, in comparison to conventional technologies—interactive variability in relationships or geometry between string pitch (tuning and intonation) and soundboard movement due to string tension changes or changes in environmental temperature and humidity.

b. Greater vibrational freedom for both string and soundboard.

It is also an objective of the invention to provide a bridge mechanism that allows the soundboard to be designed in such a manner as to remain independent of the necessity to withstand longitudinal (including tangential and lateral) string tension, e.g., neutral tension bridge. Building upon the previous paragraph, the soundboard can dissociate from structural necessity, i.e., function independently of form, shape, size, configuration, integrity, and design issues related to the remainder of the instrument. This will facilitate enhanced soundboard design as well as enhanced instrument design.

It is a further objective of the invention to provide a bridge mechanism to simply alter the relationship between string and fingerboard, thus affecting playability (force required to fret a note at a given pitch) pitch, and intonation, without requiring interactive adjustments to the soundboard, soundboard bracing, or neck (fingerboard) angle in relation to the soundboard or bridge, e.g., neutral tension bridge. This will facilitate and simplify tuning, maintenance, repair, and playability adjustments.

It is a further objective of the invention to provide a bridge mechanism to facilitate soundboard designs that require less structural bracing—in comparison to conventional technologies—thus simplifying construction, maintenance, and reducing mechanical failure opportunities, e.g., neutral tension bridge.

It is a further objective of the invention to provide a bridge mechanism to facilitate soundboard designs that require less mass—in comparison to conventional technologies—thus increasing the directional vibrational responsiveness of the soundboard and enhancing transient detail, overtone, and note articulation amplification, e.g., neutral tension bridge.

The objectives of the invention are achieved as illustrated and described. In an embodiment of the invention, longitudinal string tension is distributed between the string nut (fingerboard) and an anchor point located independently of the bridge and soundboard. The bridge intonates the stringed instrument and couples vibration of the strings to the vibration of the soundboard, amplifying string movement. These objectives are accomplished without transferring longitudinal, tangential, or lateral string tension to the soundboard, e.g., neutral tension bridge.

DETAILED DESCRIPTION OF THE INVENTION

Figure 1:
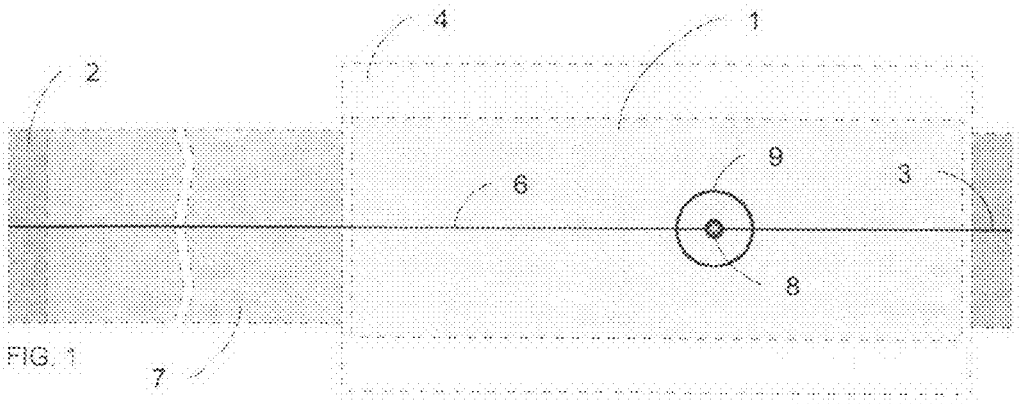
FIG. 1 is a top view of the neutral tension bridge in conformance with an embodiment of the invention.

In one installed embodiment of the invention illustrated in FIG. 1, neutral tension bridge comprises a tube assembly mechanically coupled to the soundboard 1, between the string nut 2, and string anchor point 3 located independently of the soundboard. The string anchor point can be mechanically coupled with the neck and/or body of the instrument 4. The tube assembly can be of suitable size, shape, or material to facilitate string vibration coupling while minimizing soundboard movement restriction.

Figure 2:
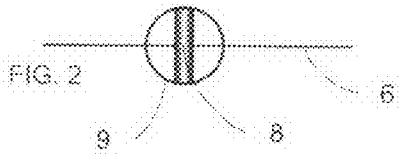
FIG. 2 is a top view of an alternate embodiment of the neutral tension bridge of FIG. 1.

As illustrated in FIG. 1, the tube assembly can be advantageously formed as an integral part of the soundboard by injection molding or casting suitable materials, or coupled directly to the soundboard, or utilizing a mounting device comprising one or more supports 5. In an optimal arrangement, the tube assembly can simply alter the relationship between string 6 and fingerboard 7, thus affecting string pitch, playability (force required to fret a note at a given pitch) and intonation, without requiring interactive adjustments to the soundboard, soundboard bracing, or neck (fingerboard) angle in relation to the soundboard or bridge, e.g., neutral tension bridge. FIG. 2 is an exploded top view of an alternate embodiment wherein the string contact point 8 is arranged horizontally rather than vertically (in relation to the soundboard).

Figure 3:
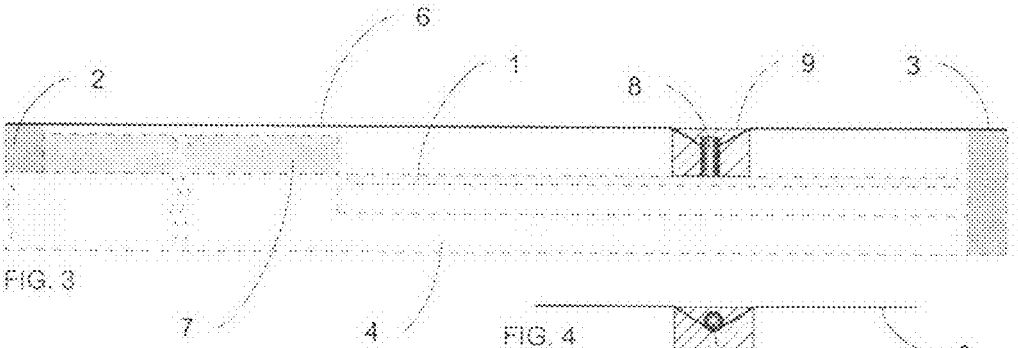
FIG. 3 is a side view of the neutral tension bridge of FIG. 1.
Figure 4:
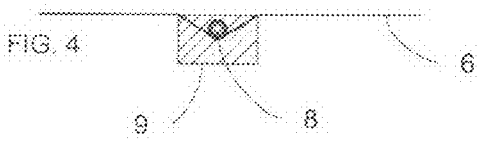
FIG. 4 is a side view of the neutral tension bridge of FIG. 2.

Within the tube assembly, as illustrated in FIG. 3, at least one adjustable string contact point 8 alters the longitudinal direction of the string, in conjunction with at least one other string contact point located on or independent of the outer tube assembly 9. String contact point 8 can be of suitable size, shape, or material to facilitate string vibration coupling while enabling longitudinal string tension adjustments. Non-limiting examples include cams, torsional mechanisms, screws, springs, hooks, and levers. FIG. 4 is an exploded side view of an alternate embodiment wherein the string contact point 8 is arranged horizontally rather than vertically.

Figure 5:
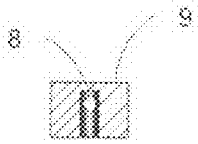
FIG. 5 is a front view of the neutral tension bridge of FIG. 1.
Figure 6:
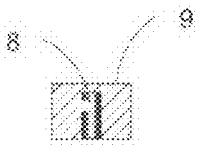
FIG. 6 is a front view of an alternate embodiment of the neutral tension bridge of FIG. 1.
Figure 7:
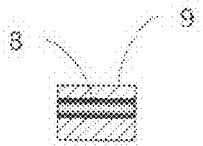
FIG. 7 is a front view of an alternate embodiment of the neutral tension bridge of FIG. 2.
Figure 8:
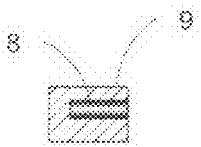
FIG. 8 is a front view of an alternate embodiment of the neutral tension bridge of FIG. 2.

FIGS. 5, 6, 7, and 8 include exploded front views of alternate embodiments. FIGS. 5 and 6 depict vertically arranged string contact points 8. FIGS. 7 and 8 illustrate horizontally arranged string contact points.

Figure 9:
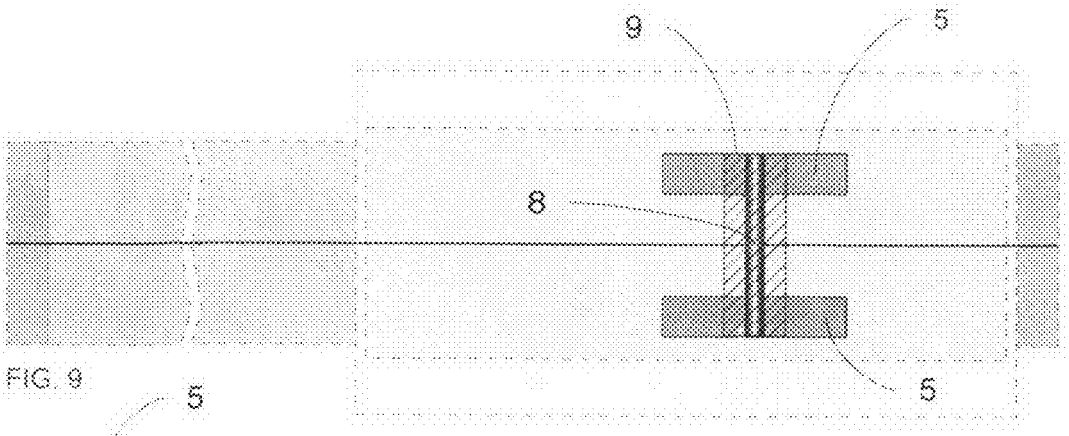
FIG. 9 is a cross section top view of the neutral tension bridge in conformance with an embodiment of the invention.
Figure 10:
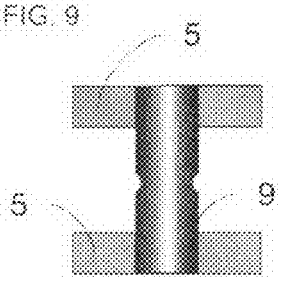
FIG. 10 is a top view of an alternate embodiment of the neutral tension bridge of FIG. 9.
Figure 11:
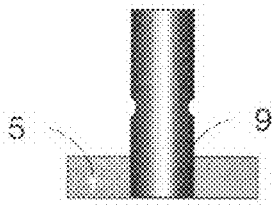
FIG. 11 is a top view of an alternate embodiment of the neutral tension bridge of FIG. 9.
Figure 12:
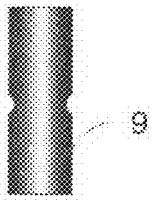
FIG. 12 is a top view of an alternate embodiment of the neutral tension bridge of FIG. 9.
Figure 13:
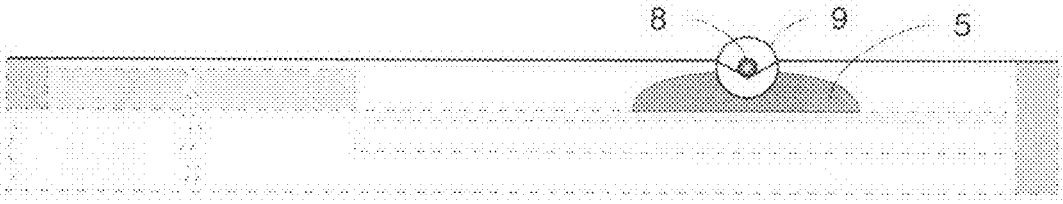
FIG. 13 is a side view of the neutral tension bridge of FIG. 9.
Figure 14:
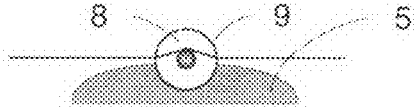
FIG. 14 is a side view of an alternate embodiment of the neutral tension bridge of FIG. 9.

FIGS. 9, 10, 11, and 12 include top views of alternate embodiments of a tube assembly neutral tension bridge. FIG. 9 is a cross section view with two supports 5, depicting a horizontally arranged string contact point 8. String contact point 8 can be of suitable size, shape, or material to facilitate string vibration coupling while enabling longitudinal string tension adjustments. Non-limiting examples include cams, torsional mechanisms, screws, springs, hooks, and levers. FIG. 10 has two supports 5. FIG. 11 has one support, in a cantilevered arrangement. The tube assembly illustrated in FIG. 12 is directly coupled to the soundboard.

Figure 15:
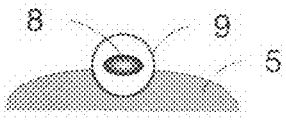
FIG. 15 is a side view of an alternate embodiment of the neutral tension bridge of FIG. 9.
Figure 16:
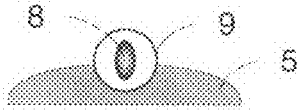
FIG. 16 is a side view of an alternate embodiment of the neutral tension bridge of FIG. 9.

FIGS. 13, 14, 15, and 16 include side views of alternate embodiments of a tube assembly neutral tension bridge. FIGS. 15 and 16 depict an asymmetrical rotating cam, as one non-limiting example of a string contact point 8 string tensioning device.

Figure 17:
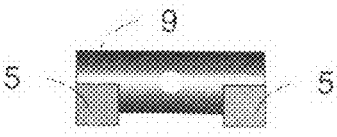
FIG. 17 is a front view of the neutral tension bridge of FIG. 10.
Figure 18:
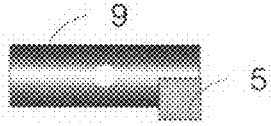
FIG. 18 is a front view of an alternate embodiment of the neutral tension bridge of FIG. 11.
Figure 19:
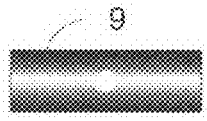
FIG. 19 is a front view of an alternate embodiment of the neutral tension bridge of FIG. 12.

FIGS. 17, 18, and 19 include front views of alternate embodiments of a tube assembly neutral tension bridge. FIG. 17 has two supports. FIG. 18 has one support, in a cantilevered arrangement. The tube assembly illustrated in FIG. 19 is directly coupled to the soundboard.

Figure 20:
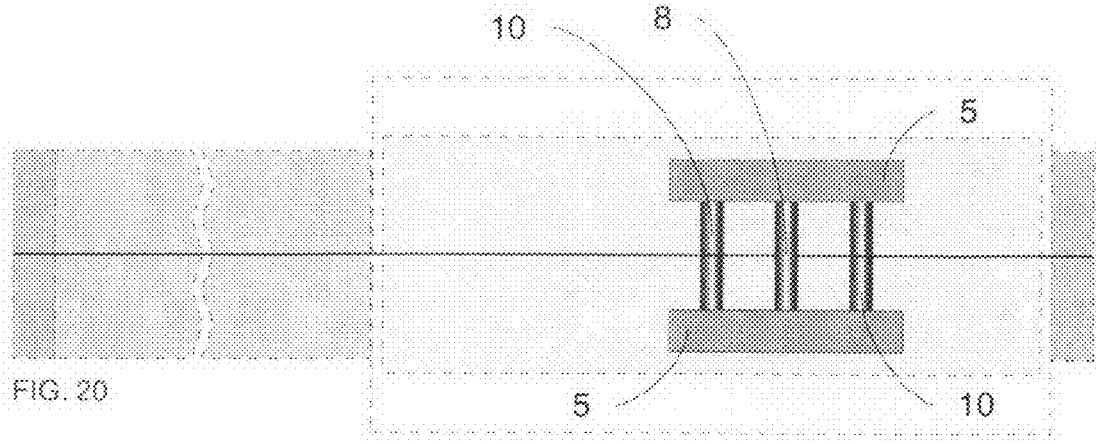
FIG. 20 is a top view of the neutral tension bridge in conformance with an embodiment of the invention.

In one installed embodiment of the invention illustrated in FIG. 20, neutral tension bridge comprises a string contact point cross member assembly 10 mechanically coupled to the soundboard 1, between the string nut 2, and string anchor point 3 located independently of the soundboard. The string anchor point can be mechanically coupled with the neck and/or body of the instrument 4. The string contact point assembly can be of suitable size, shape, or material to facilitate string vibration coupling while minimizing soundboard movement restriction.

Figure 21:
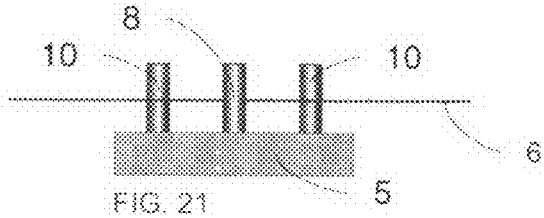
FIG. 21 is a top view of an alternate embodiment of the neutral tension bridge of FIG. 20.

As illustrated in FIG. 20, the string contact point assembly can be advantageously formed as an integral part of the soundboard by injection molding or casting suitable materials, or coupled directly to the soundboard, or utilizing a mounting device comprising one or more side member supports 5. In an optimal arrangement, the string contact point assembly can simply alter the relationship between string 6 and fingerboard 7, thus affecting string pitch, playability (force required to fret a note at a given pitch) and intonation, without requiring interactive adjustments to the soundboard, soundboard bracing, or neck (fingerboard) angle in relation to the soundboard or bridge, e.g., neutral tension bridge. FIG. 21 includes an exploded top view of an alternate cantilevered embodiment.

Figure 22:
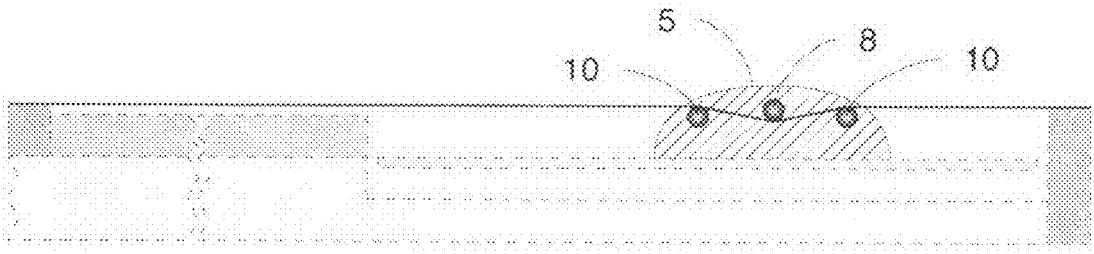
FIG. 22 is a side view of the neutral tension bridge of FIG. 20.
Figure 24:
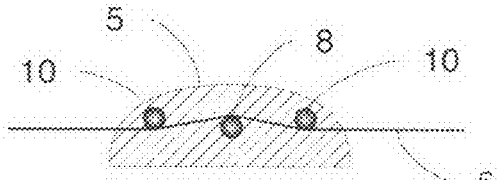
FIG. 24 is a side view of an alternate embodiment of the neutral tension bridge of FIG. 20.
Figure 23:
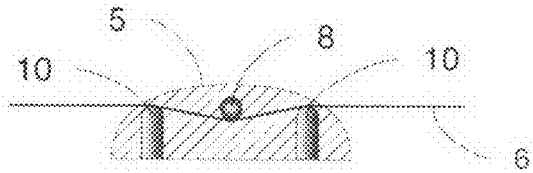
FIG. 23 is a side view of an alternate embodiment of the neutral tension bridge of FIG. 20.

Within the string contact point assembly, as illustrated in FIG. 22, at least one adjustable string contact point 8 alters the longitudinal direction of the string, in conjunction with at least one other string contact point located on or independent of the string contact point assembly 10. String contact point cross member 8 can be of suitable size, shape, or material to facilitate string vibration coupling while enabling longitudinal string tension adjustments, for example similar to FIGS. 7 and 8. Non-limiting examples include cams, torsional mechanisms, screws, springs, hooks, and levers. FIGS. 23 and 24 include exploded side views of alternate embodiments. FIG. 23 has three cross members, including two frusto conical end connected to a bar assemblies. FIG. 24 is an alternate cross member triangular pattern.

Figure 25:
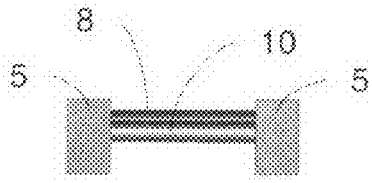
FIG. 25 is a front view of the neutral tension bridge of FIG. 20.
Figure 26:
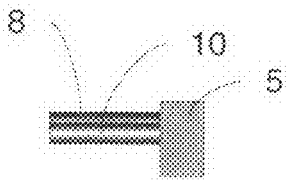
FIG. 26 is a front view of an alternate embodiment of the neutral tension bridge of FIG. 20.
Figure 27:
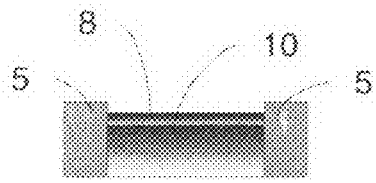
FIG. 27 is a front view of an alternate embodiment of the neutral tension bridge of FIG. 20.

FIGS. 25, 26, and 27 include front views of alternate embodiments of a string contact point assembly neutral tension bridge. FIG. 25 has two side member supports. FIG. 26 has one side member support, in a cantilevered arrangement. FIG. 27 has two supports and a frusto conical end connected to a bar cross member assembly.

Figure 28:
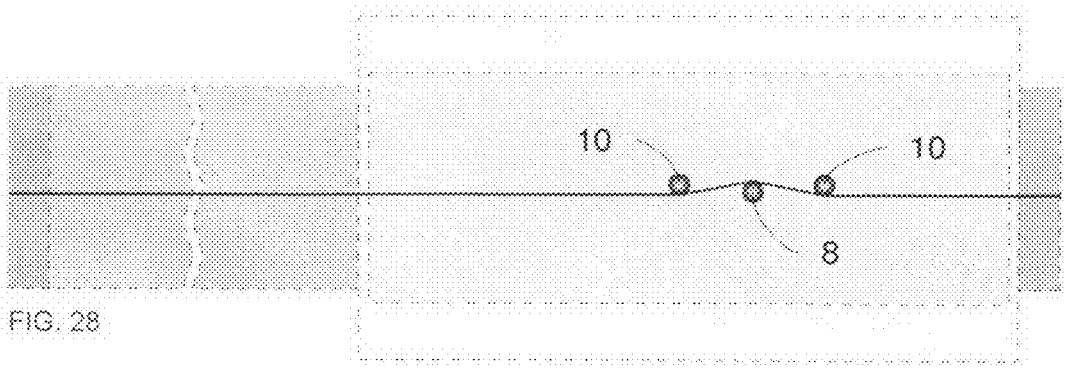
FIG. 28 is a top view of the neutral tension bridge in conformance with an embodiment of the invention.
Figure 29:
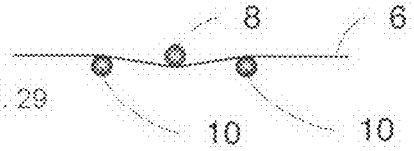
FIG. 29 is a top view of an alternate embodiment of the neutral tension bridge of FIG. 28.

As illustrated in FIG. 28, the triangular pattern string contact point assembly can be advantageously formed as an integral part of the soundboard by injection molding or casting suitable materials, or coupled directly to the soundboard. In an optimal arrangement, the string contact point assembly can simply alter the relationship between string 6 and fingerboard 7, thus affecting string pitch, playability (force required to fret a note at a given pitch) and intonation, without requiring interactive adjustments to the soundboard, soundboard bracing, or neck (fingerboard) angle in relation to the soundboard or bridge, e.g., neutral tension bridge. FIG. 29 includes an exploded top view of an alternate triangular pattern embodiment.

Figure 30:
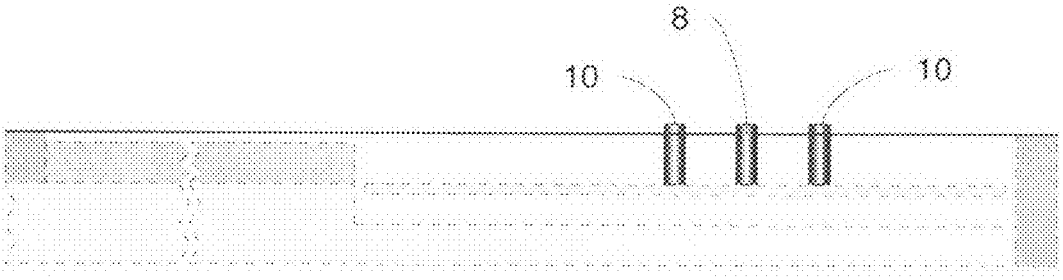
FIG. 30 is a side view of the neutral tension bridge of FIG. 28.
Figure 31:
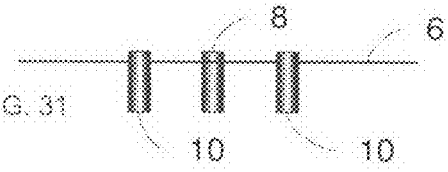
FIG. 31 is a side view of an alternate embodiment of the neutral tension bridge of FIG. 28.

Within the triangular pattern string contact point assembly, as illustrated in FIG. 30, at least one adjustable string contact point 8 alters the longitudinal direction of the string, in conjunction with at least one other string contact point located on or independent of the string contact point assembly 10. String contact point 8 can be of suitable size, shape, or material to facilitate string vibration coupling while enabling longitudinal string tension adjustments, for example similar to FIGS. 5, 6, 7, and 8. Non-limiting examples include cams, torsional mechanisms, screws, springs, hooks, and levers. FIG. 31 is an exploded side view of an alternate triangular pattern embodiment with longitudinal string direction changes reversed.

Figure 32:
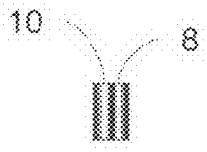
FIG. 32 is a front view of the neutral tension bridge of FIG. 28.
Figure 33:
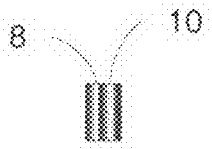
FIG. 33 is a front view of an alternate embodiment of the neutral tension bridge of FIG. 28.

FIGS. 32 and 33 include front views of alternate triangular pattern embodiments of a string contact point assembly neutral tension bridge. Longitudinal string direction changes are reversed.

Figure 34:
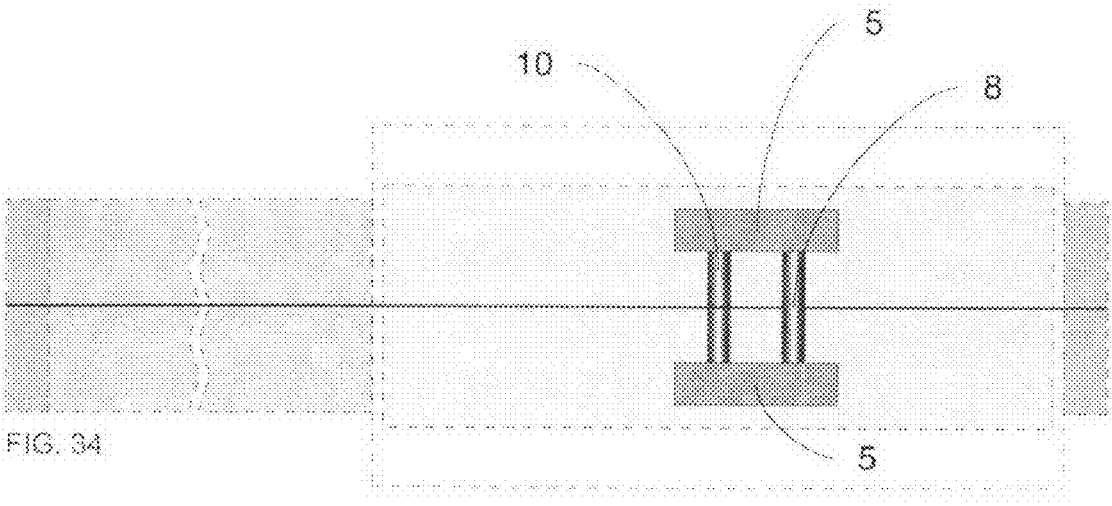
FIG. 34 is a top view of the neutral tension bridge in conformance with an embodiment of the invention.

FIG. 34 is a top view of an alternate embodiment of a string contact point assembly neutral tension bridge. Configuration similar to FIG. 20, but with one less string contact point cross member.

Figure 35:
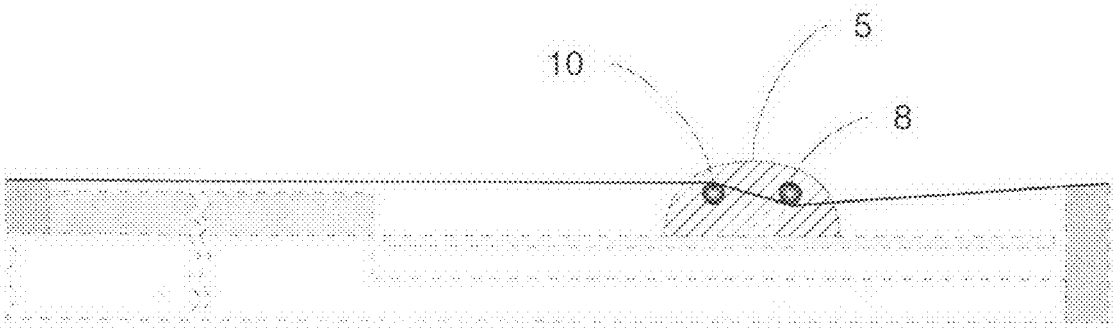
FIG. 35 is a side view of the neutral tension bridge of FIG. 34.

FIG. 35 is a side view of an alternate embodiment of a string contact point assembly neutral tension bridge. Configuration similar to FIG. 22, but with one less string contact point cross member.

DETAILED DESCRIPTION OF THE INVENTION

Figure 36:
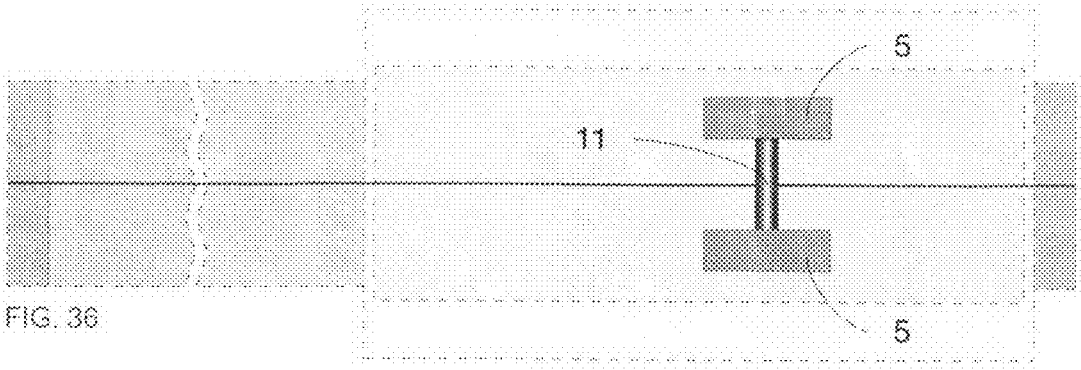
FIG. 36 is a top view of the neutral tension bridge in conformance with an embodiment of the invention.

In one installed embodiment of the invention illustrated in FIG. 36, neutral tension bridge comprises a string clamp assembly mechanically coupled to the soundboard 1, between the string nut 2, and string anchor point 3 located independently of the soundboard. The string anchor point can be mechanically coupled with the neck and/or body of the instrument 4. The string clamp assembly can be of suitable size, shape, or material to facilitate string vibration coupling while minimizing soundboard movement restriction.

Figure 37:
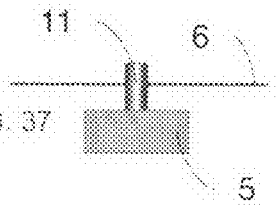
FIG. 37 is a top view of an alternate embodiment of the neutral tension bridge of FIG. 36.
Figure 38:
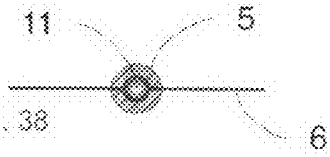
FIG. 38 is a top view of an alternate embodiment of the neutral tension bridge of FIG. 36.

As illustrated in FIG. 36, the string clamp assembly can be advantageously formed as an integral part of the soundboard by injection molding or casting suitable materials, or coupled directly to the soundboard, or utilizing a mounting device comprising one or more side member supports 5. In an optimal arrangement, the string clamp assembly can simply alter the relationship between string 6 and fingerboard 7, thus affecting playability (force required to fret a note at a given pitch) and intonation, without requiring interactive adjustments to the soundboard, soundboard bracing, or neck (fingerboard) angle in relation to the soundboard or bridge, e.g., neutral tension bridge. FIG. 37 is an exploded top view of an alternate cantilevered embodiment with side member support. FIG. 38 is an alternate vertical embodiment wherein the support is integrated.

Figure 39:
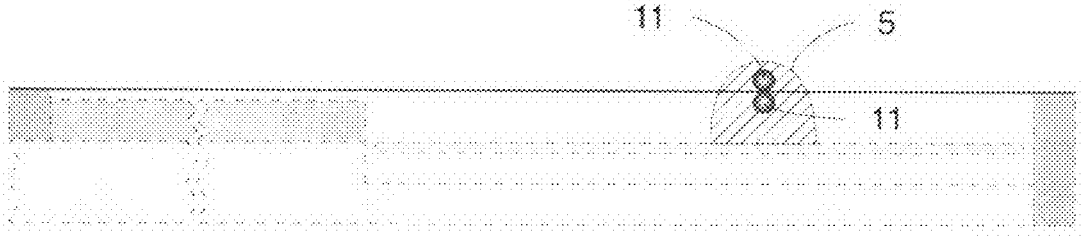
FIG. 39 is a side view of the neutral tension bridge of FIG. 36.
Figure 41:
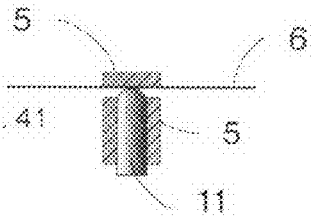
FIG. 41 is a side view of an alternate embodiment of the neutral tension bridge of FIG. 36.
Figure 40:
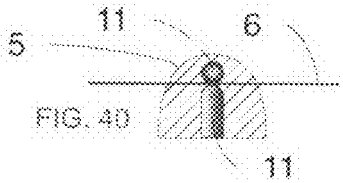
FIG. 40 is a side view of an alternate embodiment of the neutral tension bridge of FIG. 36.
Figure 42:
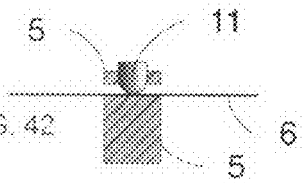
FIG. 42 is a side view of an alternate embodiment of the neutral tension bridge of FIG. 36.

Within the string clamp assembly, as illustrated in FIG. 39, at least two adjustable string contact points 11, clamp the string. String contact points 11 can be of suitable size, shape, or material to facilitate string vibration coupling while enabling longitudinal string tension adjustments. Non-limiting examples include cams, torsional mechanisms, screws, springs, hooks, and levers. FIGS. 40, 41, and 42 include exploded side views of alternate embodiments. FIG. 40 includes a frusto conical end connected to a bar connection member. FIG. 41 includes an integrated vertical support, as does FIG. 42.

Figure 46:
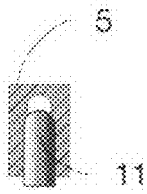
FIG. 46 is a front view of an alternate embodiment of the neutral tension bridge of FIG. 36.
Figure 43:
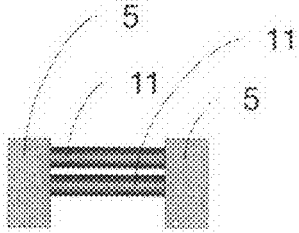
FIG. 43 is a front view of the neutral tension bridge of FIG. 36.
Figure 44:
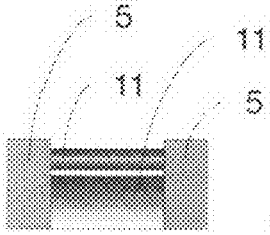
FIG. 44 is a front view of an alternate embodiment of the neutral tension bridge of FIG. 36.
Figure 45:
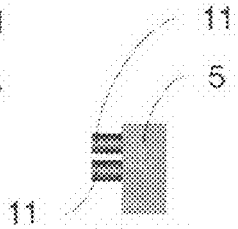
FIG. 45 is a front view of an alternate embodiment of the neutral tension bridge of FIG. 36.
Figure 47:
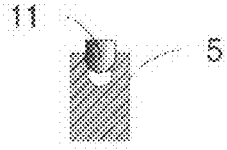
FIG. 47 is a front view of an alternate embodiment of the neutral tension bridge of FIG. 36.

FIGS. 43, 44, 45, 46, and 47 include exploded front views of alternate embodiments. FIG. 43 includes two side member supports and two connection members. FIG. 44 includes two side member supports and two connection members, one of which is a frusto conical end connected to a bar. FIG. 45 includes one side member support in a cantilevered embodiment. FIG. 46 includes an integrated vertical support, as does FIG. 47.

Figure 48:
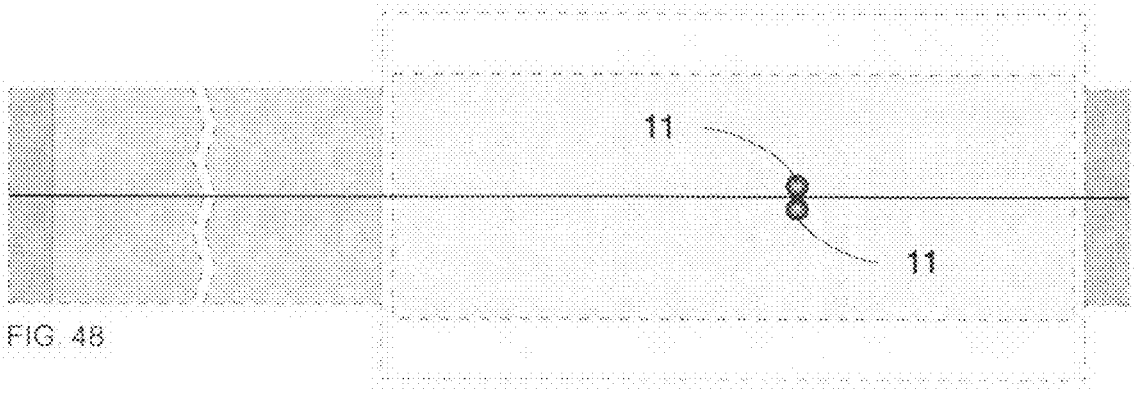
FIG. 48 is a top view of the neutral tension bridge in conformance with an embodiment of the invention.
Figure 49:
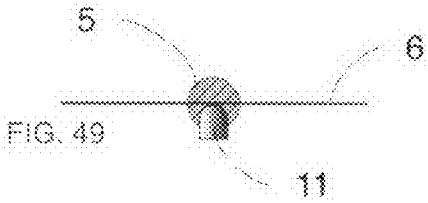
FIG. 49 is a top view of an alternate embodiment of the neutral tension bridge of FIG. 48.

FIGS. 48 and 49 include top views of alternate embodiments of a string contact point assembly neutral tension bridge. FIG. 48 includes self-supporting vertically mounted string contact points. FIG. 49 includes an integrated vertical support with a horizontal clamping mechanism.

Figure 50:
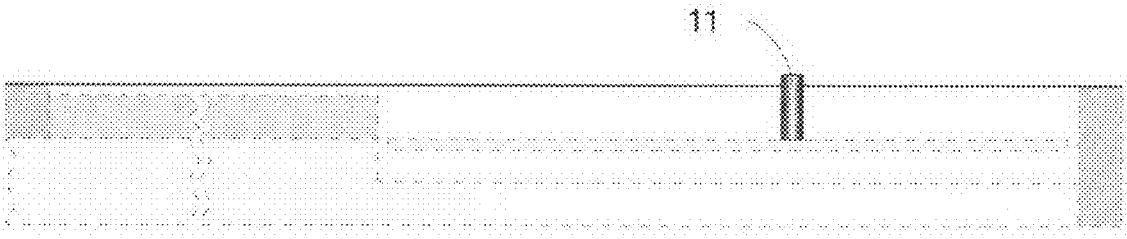
FIG. 50 is a side view of the neutral tension bridge of FIG. 48.
Figure 51:
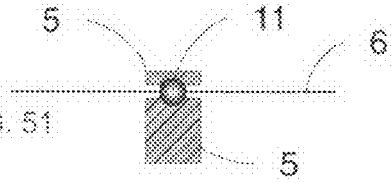
FIG. 51 is a side view of an alternate embodiment of the neutral tension bridge of FIG. 48.

FIGS. 50 and 51 include side views of alternate embodiments of a string contact point assembly neutral tension bridge. FIG. 50 is side view of FIG. 48. FIG. 51 is cross section side view of FIG. 49.

Figure 52:
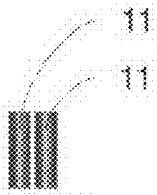
FIG. 52 is a front view of the neutral tension bridge of FIG. 48.
Figure 53:
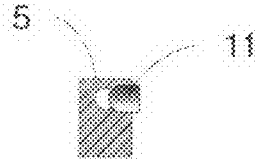
FIG. 53 is a front view of an alternate embodiment of the neutral tension bridge of FIG. 48.

FIGS. 52 and 53 include front views of alternate embodiments of a string contact point assembly neutral tension bridge. FIG. 52 is side view of FIG. 50. FIG. 53 is cross section side view of FIG. 51.

Figure 54:
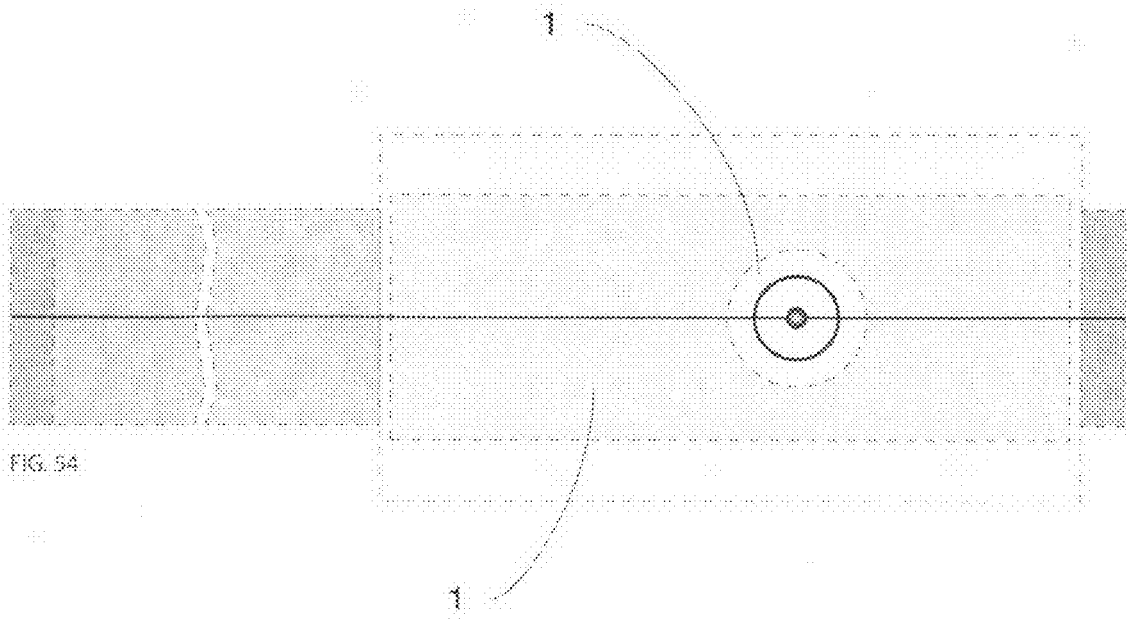
FIG. 54 is a top view of the neutral tension bridge in conformance with an embodiment of the invention.

In one installed embodiment of the invention illustrated in FIG. 54, neutral tension bridge can be coupled directly to the soundboard and/or mounted so as to be used in conjunction with at least one additional soundboard. Any embodiment of the neutral tension bridge, as described in points proceeding, can function in a multiple soundboard configuration.

Figure 55:
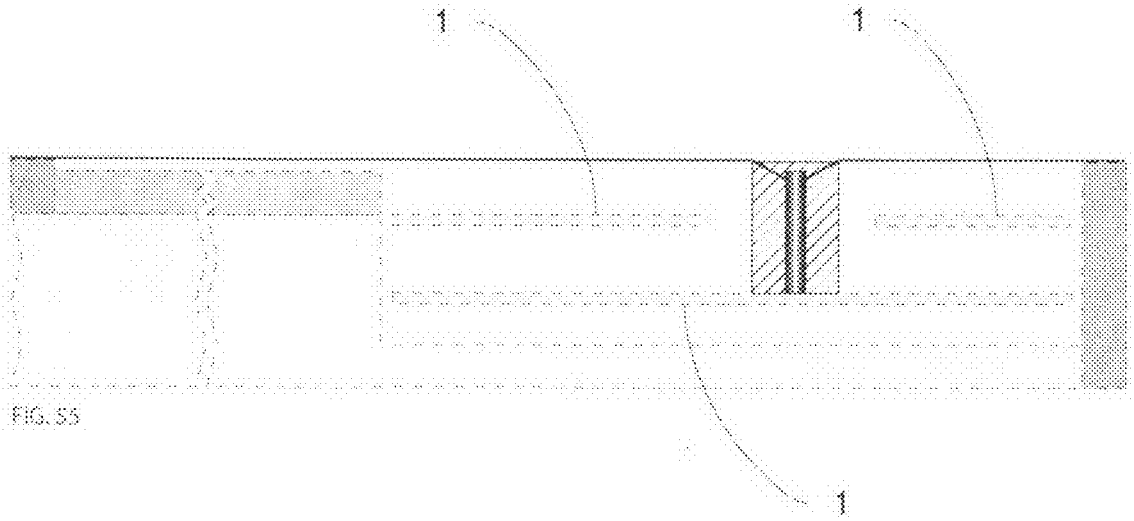
FIG. 55 is a side view of the neutral tension bridge of FIG. 54.

FIG. 55 is a side view of the embodiment illustrated in FIG. 54. In this cross section embodiment, a tube assembly neutral tension bridge is mounted to a soundboard inside the body of the instrument.

Figure 56:
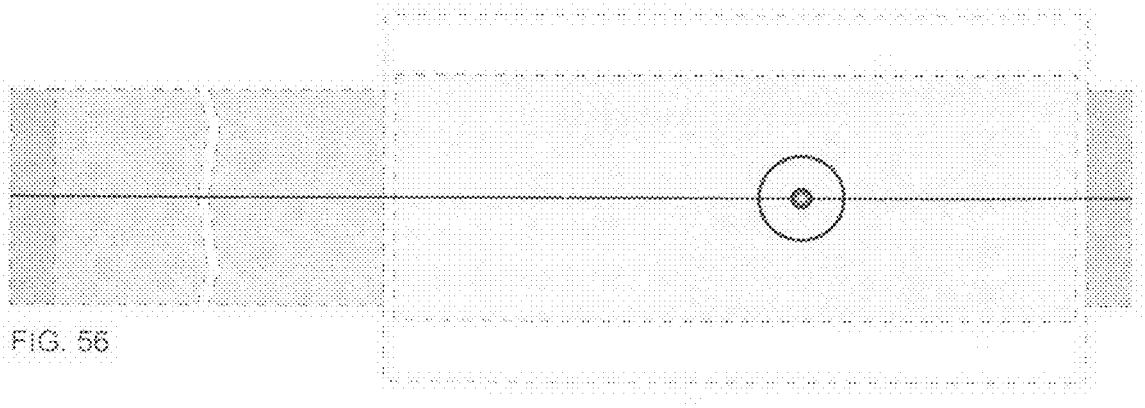
FIG. 56 is a top view of the neutral tension bridge in conformance with an embodiment of the invention.

FIG. 56 is a top view of an alternate tube assembly embodiment of the arrangement illustrated in FIG. 54.

Figure 57:
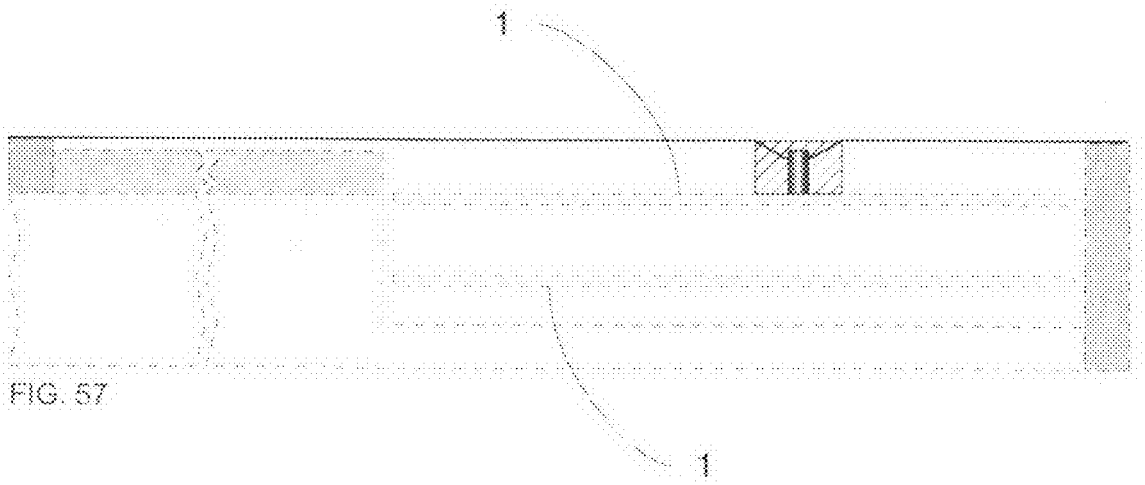
FIG. 57 is a side view of the neutral tension bridge of FIG. 56.

FIG. 57 is a side view of the embodiment illustrated in FIG. 56. In this cross section embodiment, a tube assembly neutral tension bridge is mounted to a soundboard on the body of the instrument, as a second soundboard 1, freely vibrates in sympathetic response.

What is claimed is:

1. A bridge mechanism for keeping at least one string on a musical instrument at a desired tension, comprising:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once, wherein the first body is at least one tube.

2. A bridge mechanism for keeping at least one string on a musical instrument at a desired tension, comprising:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once, wherein the first body is configured of a cast material.

3. A bridge mechanism for keeping at least one string on a musical instrument at a desired tension, comprising:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once, wherein the first body has at least a first side member a second side member and at least three cross members extending between the first side member and the second side member.

4. The bridge mechanism in according to claim 3, wherein the cross members are positioned in a triangular pattern.

5. The bridge mechanism according to claim 3, wherein at least one cross member has a frusto conical end connected to a bar.

6. The bridge mechanism according to claim 5, wherein at least two cross members have a frusto conical end connected to a bar.

7. Abridge mechanism for keeping at least one string on a musical instrument at a desired tension, comprising:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once, wherein the first body has at least a first side member and at least three cross members extending from the first side member.

8. The bridge mechanism according to claim 7, wherein the at least three cross members are positioned in a triangular geometry.

9. A bridge mechanism for keeping at least one string on a musical instrument at a desired tension, comprising:

a first body having a string contact point located at an intonation harmonic;

at least one other string contact point located at one of said intonation harmonic and between intonation harmonics wherein the string anchor point is located independently of the soundboard; and a string arranged between said string contact points, wherein the string changes longitudinal direction at least once, wherein the first body has a first side member, a second side member and a clamping mechanism for the string.

10. The bridge mechanism according to claim 9, wherein the clamping mechanism has a first side member, a second side member and at least two connection members extending from the first side member and the second side member.

11. A stringed instrument, comprising:

a body with at least two faces;

a neck connected to the body;

at least one soundboard connected to one of a face of the body of the instrument and inside the body of the instrument;

at least one string; and a bridge mechanism connected to the at least one soundboard for keeping the at least one string on the musical instrument at a desired tension, the bridge mechanism comprising:

a first body having a string contact point located at an intonation harmonic;

at least one other string contact point located at one of the intonation harmonic and between intonation harmonics wherein a string anchor point is located independently of the at least one soundboard; and wherein the string is arranged between the string contact points, wherein the string changes longitudinal direction at least once, and wherein the first body has at least a first side member a second side member and at least three cross members extending between the first side member and the second side member.

* * * * *